United States Patent [19]

Garneau

[11] Patent Number: 4,516,695

[45] Date of Patent: May 14, 1985

[54] CHILD-RESISTANT LIQUID DISPENSER SPRAYER OR LIKE APPARATUS

[75] Inventor: Richard P. Garneau, Davie, Fla.

[73] Assignee: The AFA Corporation, Hialeah, Fla.

[21] Appl. No.: 232,782

[22] Filed: Feb. 9, 1981

[51] Int. Cl.[3] ..... B05B 1/12

[52] U.S. Cl. ..... 222/153; 222/380; 239/478

[58] Field of Search ..... 222/153, 207, 380, 384; 239/359, 478

[56] References Cited

U.S. PATENT DOCUMENTS

| | | | |
|---|---|---|---|
| 4,204,614 | 5/1980 | Reeve | 222/153 |
| 4,234,128 | 11/1980 | Quinn et al. | 239/478 |
| 4,257,561 | 3/1981 | McKinney | 222/153 X |
| 4,346,821 | 8/1982 | Wesner et al. | 222/153 |

*Primary Examiner*—F. J. Bartuska

*Attorney, Agent, or Firm*—Thomas R. Vigil

[57] ABSTRACT

A child-resistant nozzle in combination with a hand operated sprayer is disclosed. The nozzle and the discharge end of the sprayer are movable into positions of relative adjustment including a liquid flow OFF position and one or more liquid flowing positions and have cooperating surfaces in which passages are formed, which passages when brought into register by relative adjustment of the nozzle and discharge end determine the mode of liquid discharge, i.e., SPRAY or STREAM. Locking members are also provided on the nozzle or discharge end which cooperate when engaged by other parts of the device to prevent sprayer operation by preventing relative adjustment of the nozzle and discharge end from said liquid flow OFF position without the application, simultaneously, of discrete, predetermined actions of the members and parts.

13 Claims, 10 Drawing Figures

CHILD-RESISTANT LIQUID DISPENSER SPRAYER OR LIKE APPARATUS

BACKGROUND OF THE INVENTION

1. Field of the Invention

This invention relates to fluid ejection devices having nozzles for their discharge ends which can be moved into various positions of relative adjustment to eject or discharge fluids, particularly liquids, in various modes or patterns including a child-resistant, fluid flow OFF position. More particularly, this invention relates to hand-held trigger operated, fluid, particularly liquid, ejecting devices having adjustable nozzles which automatically become child-resistant when moved to the aforesaid fluid flow OFF position of relative adjustment.

2. Description of the Prior Art

Sprayers and ejection devices having nozzles capable of being moved about a discharge end of the device to different positions in which fluid, particularly liquid, from a container can be ejected in various forms or patterns, also called ejection or discharge modes, are well known to the art, for example, the devices and movable nozzles disclosed in the following patents:

U.S. Pat. No. 3,061,202, granted Oct. 30, 1962, considered a basic patent for this class of articles, discloses a trigger operated pump sprayer for ejecting liquid in any one of a variety of discharge modes from a steady, narrow stream to a fine mist. This device has a nozzle rotatably mounted by screw threads on its discharge end and when the nozzle is turned outwardly thereon, internal flow passages are provided through which liquid can pass relatively unobstructed for ejection from the nozzle in a steady stream. When the nozzle is turned inwardly on the discharge end, the internal areas of the flow passages are altered and skewed or whirl passageways are provided for the liquid to pass through for ejection in a fine mist, or in a fine spray mode or pattern. This device is relatively more costly to manufacture and is disadvantageously fabricated of many parts, including some of very expensive materials and is easily operated by young children or unwary adults, there being no means provided to render the device child-resistant;

U.S. Pat. No. 3,650,473 dated Mar. 21, 1972, also disclosing an adjustable nozzle for a trigger sprayer including a closed or OFF position, has, in addition a permanent seal means provided for shipping the sprayer pre-assembled on a filled container. The seal means must be destroyed before the sprayer can be used, and thus, though initially possessing a degree of child-resistant effectiveness, once the seal is opened and destroyed, the child-resistant effectiveness once possessed is permanently lost;

U.S. Pat. No. 3,843,030, issued Oct. 22, 1974, discloses a nozzle for spraying devices which is movably attached to the discharge end thereof and adjustable to provide spraying in one or more modes, and includes a liquid flow OFF position. No means is provided to prevent operation by young children, however, and the device can be moved with ease from its liquid flow OFF position to a liquid flow ON position and operated simply by the pull of a trigger, an act easily accomplished by young, even pre-school age children;

U.S. Pat. No. 3,967,765, issued July 6, 1976 discloses a device closely similar to the preceding patented device, however, it too is devoid of significant child-resistant effectiveness;

U.S. Pat. No. 3,973,700, issued Aug. 10, 1976, discloses a hand-held, trigger operated sprayer with an adjustable nozzle which is movable on the discharge end of the sprayer from a liquid flow OFF position to a liquid flow ON position. Means in the form of a projection 68 provides a seal for the nozzle when in its liquid flow OFF position thereby endowing the device with some degree of child-resistant effectiveness. It is clear, however, that its child-resistant effectiveness is not acquired automatically when its nozzle is returned to its OFF position, as in the present invention;

U.S. Pat. No. 4,234,128, issued Nov. 18, 1980, discloses an adjustable nozzle assembly for use on the discharge end of a hand-operated compression ejection device. The nozzle is movable into different positions of relative adjustment including a liquid flow OFF position, as in the present invention, however, no means is provided in the patented device to prevent its use by young children.

Other prior art devices are known and disclosed in the following patents, none of which is considered as anticipatory of the hereinafter to be described and claimed invention;

U.S. Pat. Nos. 3,587,940, 3,685,739, 3,940,069 and RE 29,405 thereof, 4,078,700, 4,111,368, 4,128,206, 4,160,526, 4,161,288, 4,191,313, and 4,195,780.

Thus, there existed and still exists, until the present invention, a need for improved safety devices as applied to nozzles, particularly adjustable or multi-position nozzles, for hand-held, manually operated sprayers and dispensers which include means for preventing young children and unwary adults from injuring themselves and others by the untimely, or unauthorized spraying of dangerous materials from containers with which these devices are commonly used.

SUMMARY OF THE INVENTION

Among the objects of the invention is to provide a nozzle for a hand-held, fluid dispensing device in which the nozzle, though movable on a discharge end into positions of relative adjustment including a fluid flow OFF position and at least two other positions in which fluid is dispensed in characteristic modes or patterns, is safe from young children in at least the OFF position.

Another object of the invention is to provide a nozzled device of the character referred to which is child-resistant in the fluid flow OFF position and which automatically returns to that condition when the nozzle is returned to its fluid flow OFF position of relative adjustment.

An additional object of the invention is to provide a child-resistant nozzled dispenser of the type referred to which, when the nozzle is rotated to any of its other positions of relative adjustment in which fluid can be discharged in a characteristic mode or pattern, is positively engaged in that position yet is capable of disengagement with relative ease and automatically returns to its child-resistant condition when moved to its OFF position of relative adjustment.

In accomplishing these and other objects there is provided in accordance therewith a nozzled hand-held fluid, preferably liquid, ejection device having a discharge end. The nozzle is movably coupled to the discharge end in liquid flow controlling relation with respect to surfaces thereof in which flow passages are formed, and surfaces of the discharge end in which similar passages are formed, the nozzle and discharge end being relatively adjustable by rotation from a liquid flow OFF position in which liquid is prevented from flowing and discharging under child-safe conditions, to another one of a plurality of other positions, in each of which other positions liquid is discharged from the dispenser in a characteristically defined discharge mode or pattern, for example in a "stream" or a "spray".

Preferably the dispenser comprises a body having a discharge end, a nozzle, and a nozzle bushing fixed within an opening in the discharge end and coupled to the nozzle. The nozzle is movable relative to the bushing and locking means are provided on the underside of the nozzle or bushing and mating engagement means are provided on the underside of the other of the nozzle or bushing. The locking means is engagable by a trigger finger of a user of the dispenser and preferably is movable in a direction generally parallel to an axis of an outlet orifice in the nozzle. The locking means is integrally connected to said nose bushing by a molded hinge portion and has an end portion extending below said nozzle.

There is thus provided a child-resistant, in the OFF position, nozzled device for a hand-held liquid sprayer which also has positive positional indicating means which insures the nozzle is retained and aligned in each of a plurality of liquid flowing or discharging positions.

There is further provided a device of this character which has fewer parts than prior art devices, each part being simple in form, less expensive to assemble and manufacture and made in a variety of embodiments resulting in minimum costs and maximum economy resulting in part from its utilization of inexpensive thermoplastic materials such as, by way of example but not limited to, polypropylene, polyethylene, polystyrene, polyester, polycarbonate. Other well-known castable and/or moldable compounds suitable for use herewith will occur to the artisan using the invention.

DESCRIPTION OF THE PREFERRED EMBODIMENTS

Figure 1:
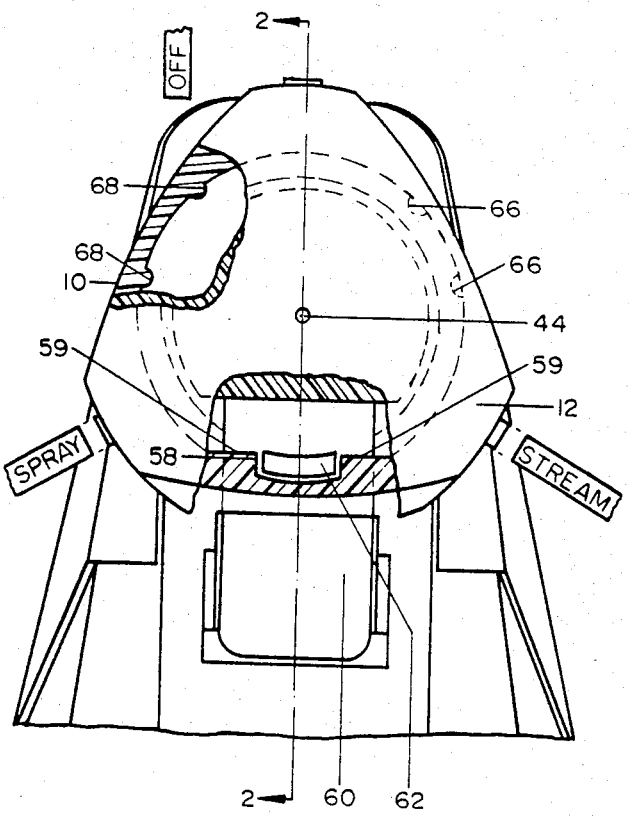
FIG. 1 is a front elevation of a preferred embodiment, parts broken away, of a child-resistant, adjustable nozzle assembled on a manually operated dispenser according to the invention, the nozzle being shown adjusted to its fluid flow OFF position and in its child-resistant condition.

Referring to the drawings and to FIGS. 1–3 and 10 in particular, there is illustrated a preferred form of the invention comprising a dispensing or ejection device 10 of the manually operated type by which fluid, hereinafter liquid, from a source (not shown) is to be ejected or otherwise discharged in one of a plurality of characteristic patterns or modes.

In these figures, liquid sprayer dispenser or ejection device 10 has an adjustable nozzle 12 assembled to the component retaining housing or body 14 on the nose or discharge end 16 thereof.

Nozzle 12 is pressed onto body 14 in rotational relation therewith on a nose bushing 17 thereof. Bushing 17 is press-fitted in discharge end 16 and nozzle 12 is retained thereon by engagement of a radial ring or bead 18 projecting from the inner surface of a skirt 20 of nozzle 12 with the radial wall surface of a ridge 22 projecting from the outer surface of bushing 17. Thus secured, nozzle 12, although restrained from movement axially relative to discharge end 16 and bushing 17, is rotationally movable thereon.

An outer seal against leakage of fluid from nozzle 12 is provided by the conical skirt-like end 24 of bushing 17, the outer surface of which bears against the adjacent, inner cylindrical surface 26 of nozzle 12, these members and parts being fabricated to interference fit tolerances.

Figure 10:
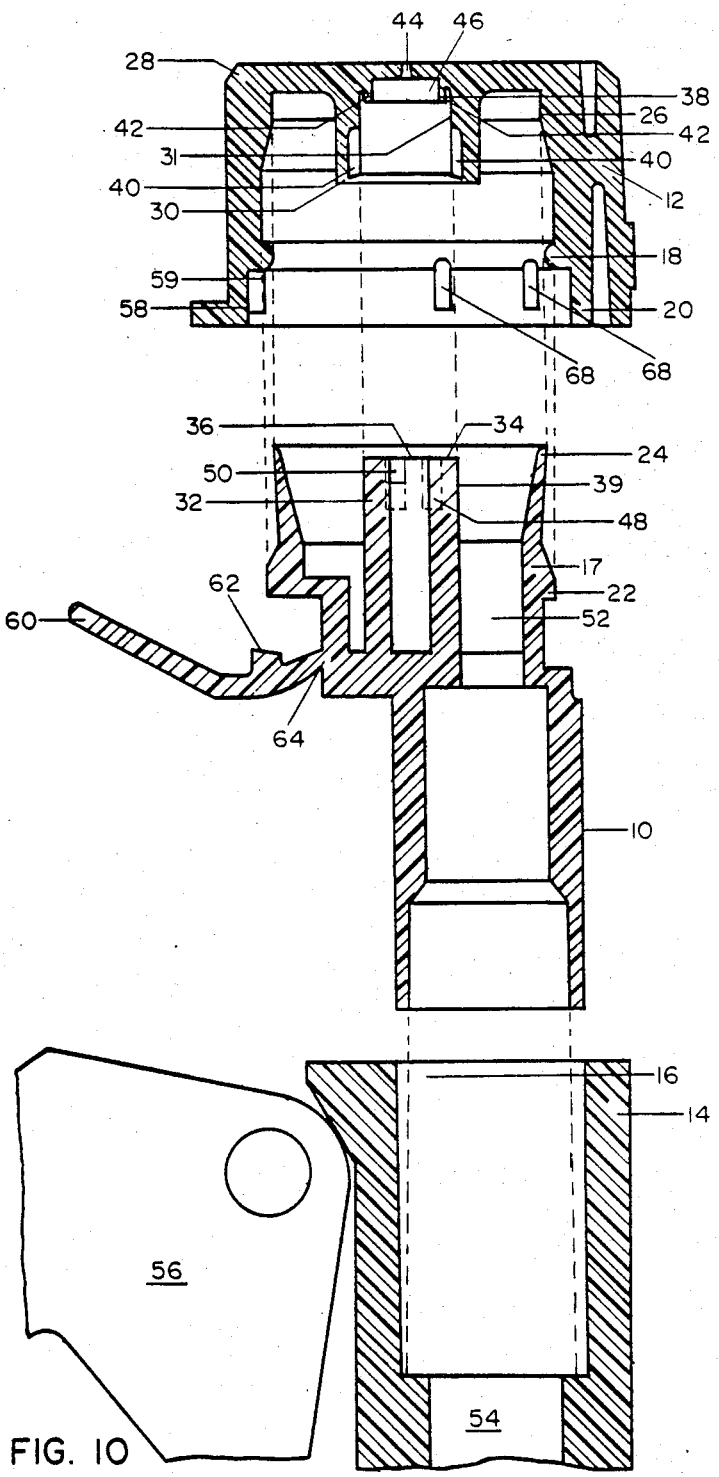
FIG. 10 is an exploded, vertical section of the invention, corresponding to FIG. 2, illustrating an insertable, preferred nose bushing for the discharge end of a manually operated ejection device or dispenser.

Nozzle 12 has an end wall 28, from the inner surface of which a cylindrical projection 30 extends. Cylinder 30 has an inner surface or wall 31 which embraces a cylindrical core or plug 32 centrally formed in bushing 17. Plug 32 terminates in an annular end wall 34 in which an opening 36 is formed, which end wall 34 contacts wall 28 in the bottom end of cylinder 30 on a shelf 38 formed thereat, as best seen in FIG. 10. Plug 32 is embraced by inner wall 31 of cylinder 30 in sealing relation, its outer surface 39 engaging inner surface 31 of cylinder 30. A fluid tight seal against external leakage when nozzle 12 is moved to its liquid flow OFF position is thereby obtained.

Figure 3:
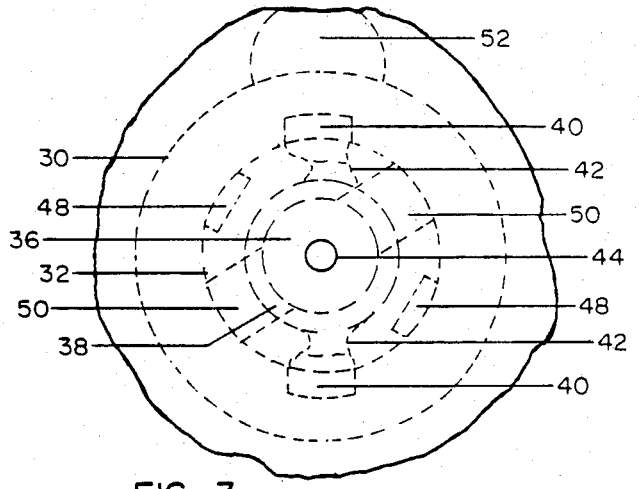
FIG. 3 is a partial, front elevation, slightly enlarged, on line 3—3 of FIG. 2.

A pair of oppositely disposed, axial passages or grooves 40 are formed in inner wall 31 of cylinder 30 which are generally rectangular in cross section, as seen best in FIG. 3, and which extend approximately one-half the length of wall 31. Shelf 38 contains a pair of oppositely disposed, radius bottomed swirl or turn passages 42 which although normally in alignment with passages 40 are not in direct communication with them. Swirl passages 42, of course, rotate with cylinder 30 and grooves 40 when nozzle 12 is rotated.

A discharge orifice 44 is provided in the central portion of end wall 28 being formed in the bottom of a shallow, walled cavity or chamber 46, defined by shelf 38 thereat which surrounds it.

Plug 32 also has a pair of axial, oppositely disposed passages or grooves 48, which are similar in cross section and substantially equal in length to passages 40 and which, in some positions of nozzle 12 adjustment, overlap passages 40 providing liquid flow communication therewith. A pair of transverse through slots 50 best seen in FIGS. 3, 6 and/or 10 are located in end wall 34 and extend therethrough to opening 36. Slots 50 also extend rearwardly into wall 34 a distance of approximately one-half the length of passage 48, at which point they are formed into steps having treads equal in length to the remaining distance, and are circumferentially displaced from passages 48 by from about 30 to about 60 degrees. A liquid supply passageway or conduit 52 in bushing 17 connects with a supply passage 54 in body 14 which in turn is in communication with a source of liquid supply (not shown).

Figure 2:
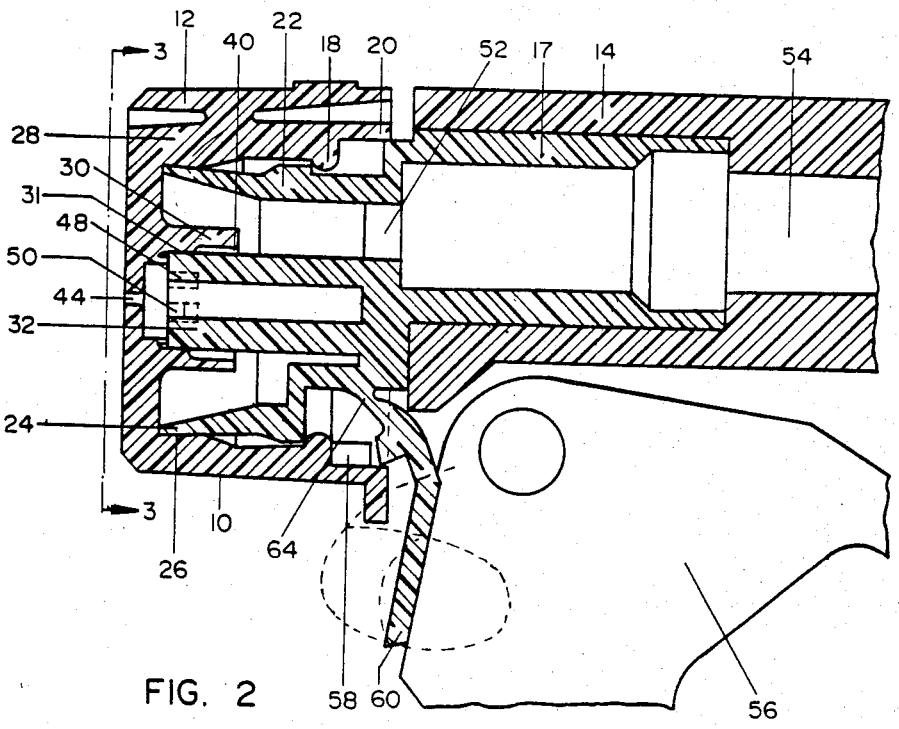
FIG. 2 is a vertical section on the line 2—2 of FIG. 1, however with the nozzle locking lever shown in a nozzle unlocking position.

As has been earlier indicated nozzle 12, assembled on bushing discharge end 16 of body 14, is rotatably adjustable relative thereto to any one of a plurality of different positions such that one or more of the various passages on, or in one part of the device cooperates with one or more passages on, or in another part of the device when brought into register therewith to form conduits for conducting liquid to and dispense liquid through orifice 44 in a predetermined, characteristic mode or pattern. Also in at least one position of relative adjustment, which position is a liquid flow OFF position, no liquid at all will flow. FIGS. 1, 2 and 3 best show this position, FIG. 1 showing nozzle 12 in its locked or child-resistant condition to be described in greater detail in what follows and FIG. 2 illustrating nozzle 12 in the aforesaid OFF position and unlocked from its child-resistant condition by a preferred mechanism for the purpose.

Figure 4:
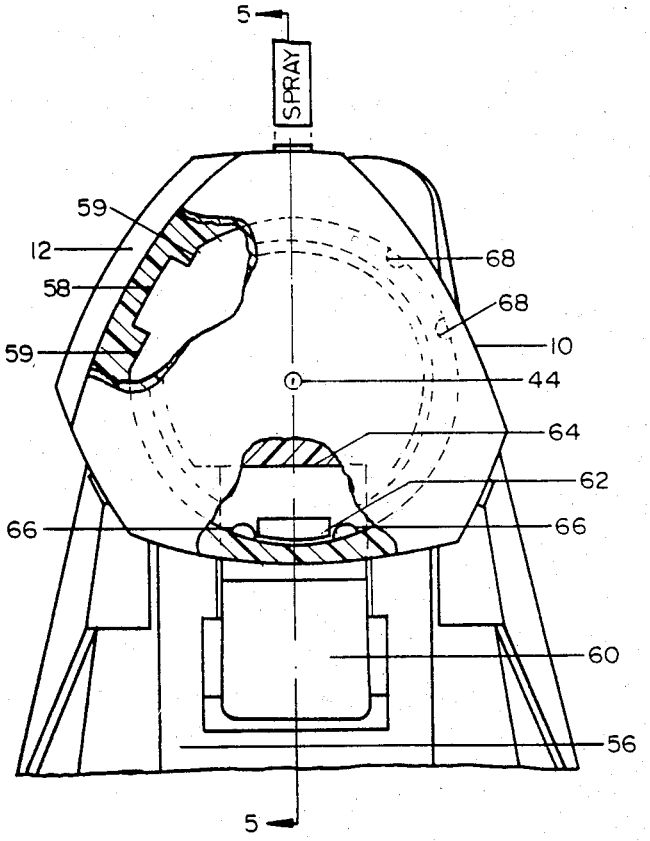
FIG. 4 is a front elevation, as in FIG. 1, parts broken away, the nozzle being shown adjusted to an indicated first, or SPRAY mode position.
Figure 5:
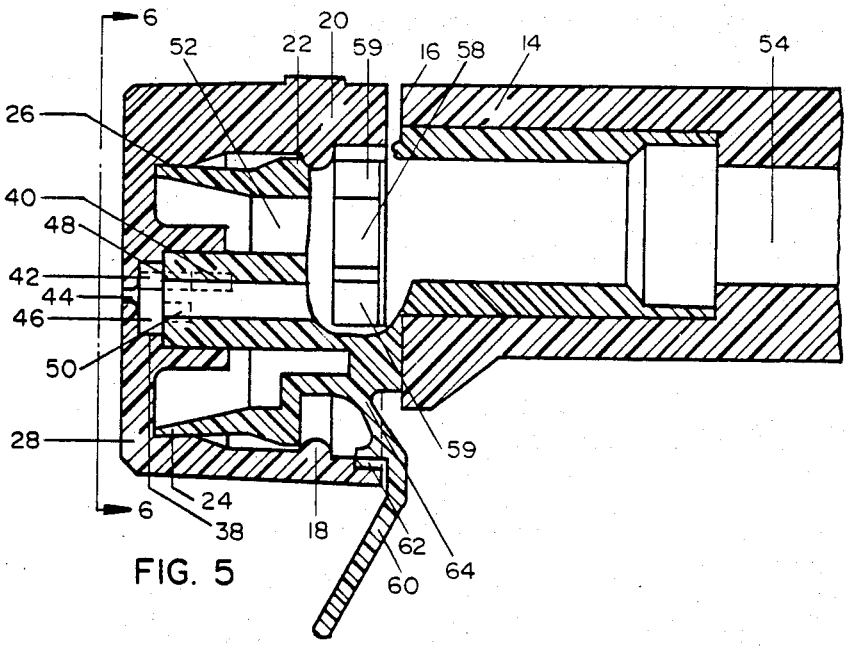
FIG. 5 is a vertical section on line 5—5 of FIG. 4, parts broken away.
Figure 6:
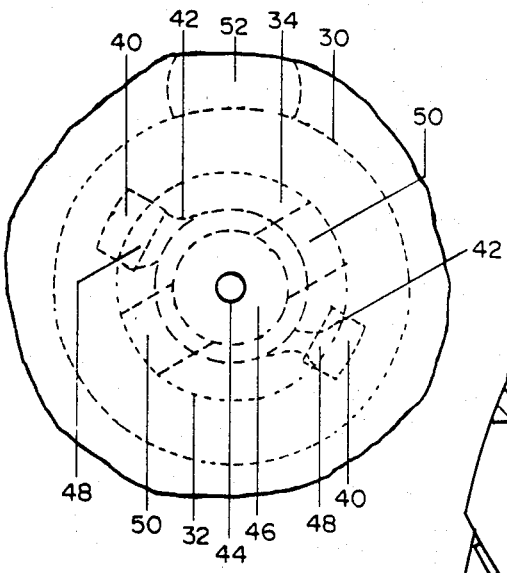
FIG. 6 is a partial, front elevation, slightly enlarged on line 6—6 of FIG. 5.

FIGS. 4, 5 and 6 illustrate ejection device 10 with nozzle 12 rotated to a "SPRAY" position of relative adjustment, FIG. 4 also showing one of the preferred position indicating and retaining means, the purpose and details of which will be described hereinafter. In this position of nozzle 12, passages 40 and 48 register with each other and liquid from conduit 54 flows into conduit 52 and thereafter, via registered passages 40 and 48, into swirl or turn passages 42 and chamber 46, being injected into the latter along a tangential path with increasing velocity owing to the curved shape of the walls of swirl passages 42 and thereafter passes through orifice 44 to be ejected therefrom in a characteristic spray pattern or mode.

Figure 7:
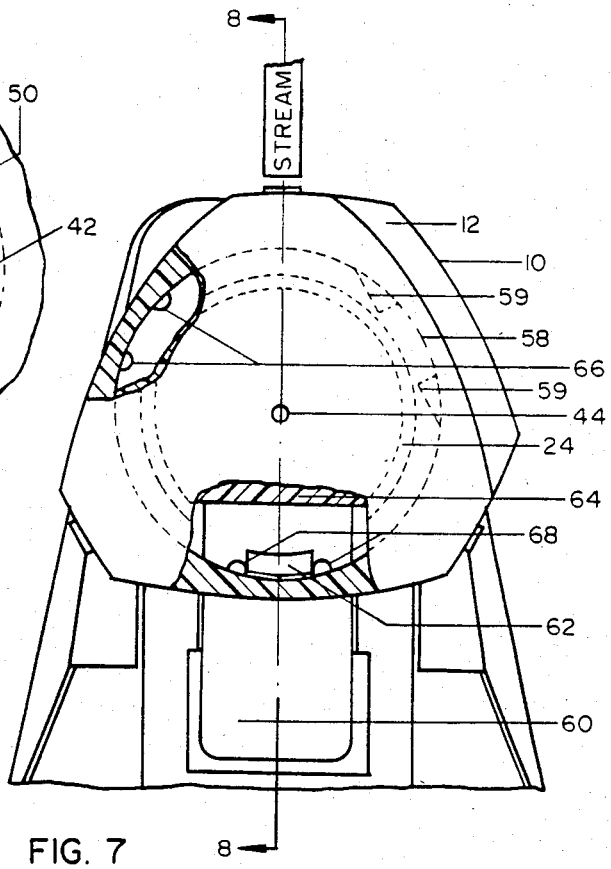
FIG. 7 is a front elevation, as in FIGS. 1 and 4, parts broken away, the nozzle being shown adjusted to a second, or STREAM mode position.
Figure 8:
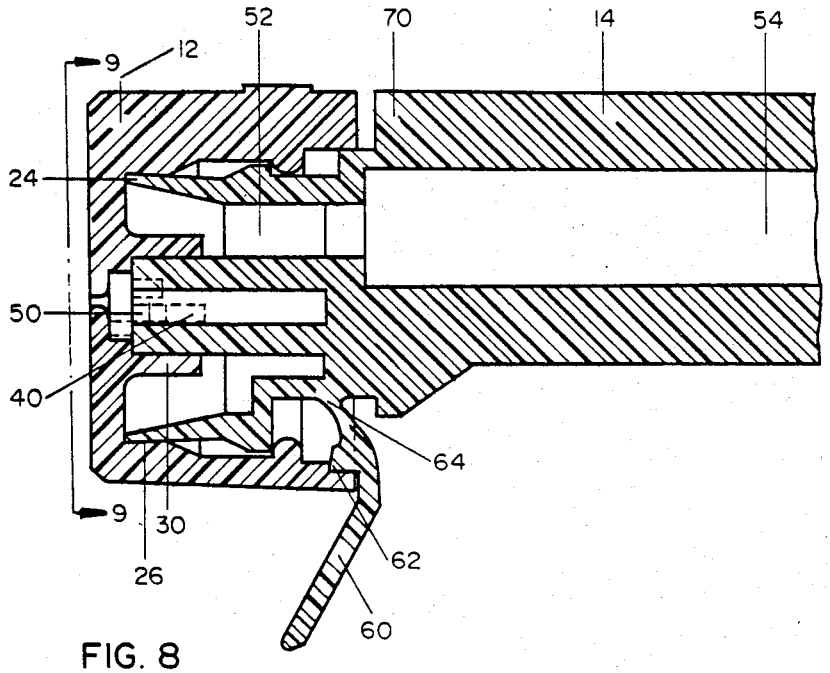
FIG. 8 is a vertical section on line 8—8 of FIG. 7 illustrating an integrally molded discharge end used with the invention.
Figure 9:
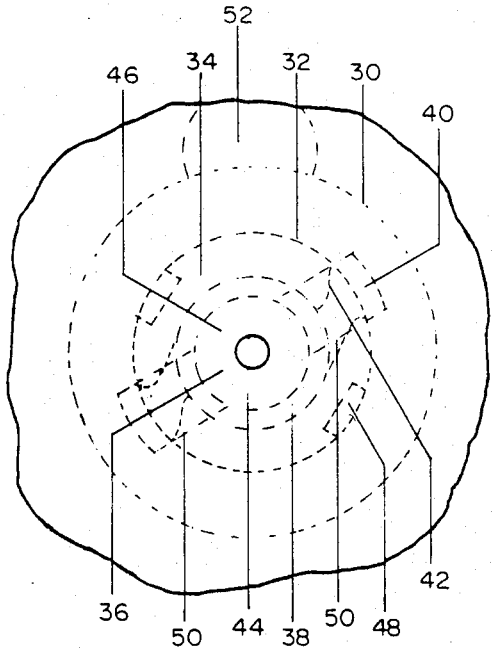
FIG. 9 is a partial, front elevation, slightly enlarged, on line 9—9 of FIG. 8.

In FIGS. 7, 8 and 9 nozzle 12 is shown rotated to a STREAM position of relative adjustment, FIG. 7 also showing an additional one of the position indicating and retaining means formed on an inner surface of nozzle 12, the purpose of which will also be described in greater detail hereinafter. In this position passages 40 are in register with through slots 50 and liquid flows directly into chamber 46 from opening 36 and slots 50 with little or no velocity increase and is ejected from orifice 44 in a characteristic narrow mode, or stream pattern.

The preceding is a detailed description of a representative and preferred form of adjustable nozzle for use with the present invention, which form of nozzle is also the subject of a previously referred to, recently issued and coowned U.S. Pat. No. 4,234,128 and to which the present invention is intended to be an improvement. For a greater and enhanced understanding and appreciation of the present invention, reference may be had to the above designated patent and its specification.

The present specification, however, having described that nozzle construction for background purposes will now describe the invention which is a new and novel means for rendering all such structures child safe, or, as known to the art, "child-resistant". By "child safe" or "child-resistant" is meant a device which possesses a quality or characteristic known to the art as "high child-resistant effectiveness" so as to satisfy the standards for special packaging under the "Poison Prevention Packaging Act of 1970". This is a description, now in widespread use, to describe devices which, when used on or in conjunction with containers of harmful or toxic materials, are rendered incapable of being opened (in the case of the containers) or "turned on" (in the case of dispensers, etc.) by a relatively high percent (80% or more) of young "pre-school age" children or unwary adults. On the other hand the devices must be relatively easily opened, or "turned on" by a similar number of normal adults.

A dispensing device having a nozzle possessing these attributes has now been discovered and will be described with reference to the included drawings and foregoing description.

In FIG. 1, as mentioned previously, nozzle 12 is depicted in its OFF position of relative adjustment with respect to discharge end 16 of body 14. In use dispenser 10 will usually be attached to or otherwise mounted on a container (not shown) the contents of which are to be dispensed by actuation of a trigger 56 pivotably attached to body 14. Actuation of trigger 56 operates an internal pump (not shown) to draw material such as liquid from the container; however, so long as nozzle 12 remains in its OFF position no liquid will be ejected from orifice 44. To insure nozzle 12 remains in its OFF position and thereby remains safe from young children, a safe, or locked condition thereof is provided which occurs, as will be seen, automatically and which, before any dispensing can be effected, must be changed to an unlocked or operative condition.

To provide the above mentioned safe condition of nozzle 12, a notch or recess 58 is formed, as by molding, in the lower, interior surface of skirt 20 of nozzle 12 in a shelf-like sector formed thereat, as best seen in FIG. 1. A pair of lead ramps 59 are also provided, one on either side of recess 58, for a purpose to be described and also best seen in FIG. 1. Referring to FIG. 2 a flexible, resilient member in the form of an integrally connected flex arm or lever 60 depends from nose bushing 17 in discharge end 16 and extends below nozzle 12. Lever or arm 60 has a forwardly projecting portion in the form of a projecting tab 62 molded on its front, intermediate surface, which in the normal, unflexed condition of lever or arm 60 is engaged in recess or notch 58 thereby locking nozzle 12 in its OFF position. As indicated by the dash line finger in FIG. 2, lever arm 60 is shown in its activated condition and nozzle 12 is unlocked, although it remains in its OFF position, with tab 62 disengaged from recess or notch 58. When flexed in the manner shown, lever or locking member 60 swings away from nozzle 12 hinging about its upper or hinge end 64 where it connects to nose bushing 17. With tab 62 disengaged from notch 58, nozzle 12 is operative and can now be moved to any preselected position of adjustment by rotation thereof about discharge end 16 and bushing 17. Rotation of nozzle 12 in either direction moves notch 58 away from its position opposite tab 62 and, if desired, flex lever 60 can be released and nozzle 12 adjusted to another position, for example, FIG. 4 or FIG. 7. If rotated to the position of FIG. 4 a spray position is reached as nozzle 12 rotates clockwise through an angle of 120°. In this new position, tab 62 on lever 60 engages a first pair of detents 66 formed or molded on the inner surface of skirt 20 circumferentially in line with notch 58. If rotated to the position of FIG. 7 on the other hand, a stream position is reached as nozzle 12 rotates either clockwise an additional 120° from the FIG. 4 position or counterclockwise 120° from the FIG. 1 position. In this position tab 62 engages a second pair of detents 68 also formed or molded on the inner surface of skirt 20 circumferentially in line with recess 58. Continued clockwise rotation through 120° from the FIG. 7 position results in the return of nozzle 12 to its OFF position of FIG. 1, tab 62 being guided into engagement with recess 58 by right hand lead ramp 59 and being urged thereinto by the resilient force supplied by flexing action of arm 60 about hinge end 64. Thus, it will be appreciated that nozzle 12 returns to its safe, or child-resistant condition automatically when rotated to its OFF position of relative adjustment from either direction.

From the foregoing, it will also be appreciated that nozzle 12 not only possesses high child-resistant effectiveness, but it also, owing to the novel use of internal, paired detents 66 and 68, possesses positive indication of adjustment and, in addition, is capable of relative ease of readjustment. That is, to move nozzle 12 to a new position of relative adjustment, it is only necessary to apply a slightly increased turning force to nozzle 12 to disengage tab 62 from its position between either detent set 66 or 68. Conversely, when adjusted to that new position, a slight resistance to further rotation will first be encountered giving indication that the new position has been reached. A further application of slightly increased turning force against nozzle 12 insures engagement of tab 62 with detents 66 or 68, depending on the direction in which nozzle 12 was moved on adjustment. External indexing means is also provided, for example, by imprinting or embossing appropriate legends such as OFF, SPRAY and/or STREAM in the proper nozzle 12 surfaces, as indicated by the respective printed legends in FIGS. 1, 4 and 7.

It is clearly apparent that young children of the ages mentioned will find it too difficult, if not impossible, to perform the necessary actions to move nozzle 12 from its locked or safe OFF position to an operating position because a relatively high degree of coordination is required. That is to say, young children will very likely not be capable of performing the separate, discrete and simultaneous actions necessary to both unlock nozzle 12 and thereafter adjust it to another position, which actions must be performed according to the following procedure:

(1) disengage tab 62 from notch or recess 58 by deflecting flex arm 60 to the extent shown in FIG. 2, and, simultaneously, while holding arm 60 in its flexed condition, (2) rotate nozzle 12 until notch 58 can no longer be engaged by tab 62 when arm 60 is released.

Referring to FIG. 8, a variation of the present invention is depicted comprising a one-piece, integrally molded discharge end 70 in place of insertable nose bushing 17 in discharge end 16, previously described. In this embodiment, owing to its one-piece, integrated construction, significant cost savings may be realized through decreased costs and complexity in design and in molding machinery and procedures used in manufacturing. Mostly, however, use of nose bushing 17 is preferred because of its inherently greater adaptability to almost any known dispenser body with only slight modification. Also, as may be realized from reference to FIG. 10, nozzle 12 can be preassembled on nose bushing 17 and the assembly sold or supplied as a separate staple of commerce to other sprayer manufacturers. In addition, with the advent of the present inventive concept, manufacturers are supplied with an economic means for converting their ordinary prior art spray devices to child-resistant, safety devices.

What has been therefore shown and described hereinbefore and is desired to be presented to the art of fluid, in particular liquid, dispensers and the like is an adjustable nozzle of high child-resistant effectiveness for use on the discharge end of a manually operated sprayer, the nozzle and discharge end being movable into positions of relative adjustment including a liquid flow OFF position and which, when adjusted to the liquid OFF position of relative adjustment, is automatically maintained in said child-resistant condition.

What is claimed is:

1. A child-resistant adjustable nozzle for a manually operated liquid dispenser, said dispenser having a body with a liquid discharge end which has an upper side and a lower side, said nozzle being coupled to said discharge end in embracing relation therewith, a nose bushing received in said nozzle and fixed to said discharge end, said nozzle being movable into different positions of relative adjustment relative to said nose bushing including a liquid flow OFF position, said nozzle and said nose bushing having surfaces in which passageways are formed, which passageways when brought into register by said adjustment of said nozzle relative to said nose bushing determine the ejection or discharge mode of said dispenser, movable locking means located at the lower side of said discharge end and provided on one of said nozzle and nose bushing and engagement means on the other of said nozzle and nose bushing, said locking means and said engagement means adapted to interengage and lock said nozzle against relative movement with respect to said nose bushing when said nozzle is moved into said liquid flow OFF position of relative adjustment, and said locking means being integrally connected to said nose bushing by a molded hinge portion, having an end portion extending below said nozzle, and being engagable by a trigger finger of the user.

2. The adjustable nozzle as in claim 1 in which said movable locking means is on said nose bushing and said engagement means is on said nozzle.

3. The adjustable nozzle as in claim 1 in which said locking means is on said nozzle and said engagement means is on said nose bushing.

4. A child-resistant adjustable nozzle for a hand-operated liquid ejection apparatus, said apparatus including a discharge end, a nose bushing on said discharge end for coupling said nozzle to said apparatus, said nozzle being movable into different positions relative to said nose bushing including a liquid flow OFF position, means in said nozzle and said nose bushing adapted to form passageways for liquid conducted to said discharge end for ejection therefrom, which passageways are formed when said means are brought into register by adjustment of said nozzle relative to said nose bushing and thereby determine the ejection or discharge mode of said apparatus, deflection means beneath said nozzle on one of said nozzle and said nose bushing cooperation engagement means on the other of said nozzle and said nose bushing adapted to engage said deflection means and lock said nozzle on said nose bushing in child-resistant relationship therewith when said nozzle is moved into said liquid flow OFF position of relative adjustment, and said deflection means comprising an end portion integrally connected by a molded hinge portion with said nose bushing.

5. A child-resistant, adjustable nozzled manually operated liquid sprayer, said sprayer having a discharge end including surfaces formed therein, a nozzle coupled to said sprayer on said discharge end, having an upper side and a lower side, and having surfaces formed therein, at least one of said surfaces embracing at least one of said discharge end surfaces and being disposed in liquid flow controlling relation with respect thereto, said nozzle being movable relative to said discharge end into different positions including a liquid flow OFF position, a surface of said discharge end and a surface of said nozzle having passageways formed therein, which passageways when brought into register by adjustment of said nozzle relative to said discharge end determine the ejection or discharge mode of the sprayer, deflectable locking means on the underside of one of said nozzle and said discharge end of said sprayer and complementary means on the underside of the other of said nozzle and discharge end of said sprayer, said locking means adapted to engage said complementary means and lock said nozzle in child-resistant relation when said nozzle and said discharge end are moved into said liquid flow OFF position, said deflectable locking means including a depending flex arm which is integral with said discharge end, which is engagable by a trigger finger of a user and which is deflectable in a direction generally parallel to the axis of an outlet orifice of said nozzle.

6. In an adjustable nozzle for the discharge end of a manually operated liquid spraying device, said nozzle being movable relative to said discharge end into different positions of relative adjustment, said nozzle and discharge end having upper and lower sides and having inner and outer surfaces, liquid flow passages formed in an inner surface of said nozzle and an outer surface of said discharge end which passages are brought into register by said relative adjustment of said nozzle and discharge end to provide different modes of liquid discharge from said sprayer, at least one of said positions of relative adjustment being a liquid flow OFF position, the improvement comprising: deflection means on the lower side of said discharge end and engagement means on said nozzle, said deflection means having a normally undeflected condition and a deflected condition, said engagement means adapted to engage said deflection means when said deflection means is in its normally undeflected condition and said nozzle is in said OFF position of relative adjustment, said engaged deflection means forming a child-resistant lock for said nozzle, and said deflection means being integral with said discharge end, being engagable by a trigger finger of a user and being movable in a direction generally parallel to an axis of an outlet orifice of said nozzle.

7. The adjustable nozzle of claim 6 in which said deflection means is a flex arm connected to said discharge end, including an integral hinge portion and an end portion extending below said nozzle adapted to be actuated by flexing by the fingers of the hand to unlock said nozzle.

8. The adjustable nozzle of claim 6 in which said engagement means is a recess located in a surface of said nozzle.

9. In combination, a child-resistant adjustable nozzle for use with a manually operated fluid dispenser having a discharge end, and a nose bushing adapted to be inserted in said discharge end of said dispenser, said nozzle adapted to be coupled to said nose bushing in embracing relation therewith, said nozzle and said bushing having an upper side and a lower side and said nozzle being movable relative to said bushing into different positions of relative adjustment including a liquid flow OFF position for said dispenser, said nozzle and said bushing having surfaces in which passageways are formed, which passageways when brought into register by said adjustment of said nozzle relative to said bushing determine the ejection or discharge mode of said dispenser, movable locking means on the lower side of one of said nozzle and said bushing and engagement means on the lower side of the other of said nozzle and bushing, said locking means being integral with said nose bushing, and said locking and engagement means adapted to interengage to lock said nozzle and bushing against further adjustment when said nozzle and bushing are moved into said liquid flow OFF position.

10. The combination as in claim 9 in which said movable locking means is on said bushing and said engagement means is on said nozzle.

11. The combination as in claim 9 in which the nose bushing is press fitted in said discharge end of said dispenser and said locking means is integrally connected to said bushing.

12. The combination as in claim 9 wherein said locking means is integrally connected to said bushing by a molded hinge and includes an end portion which extends from said hinge below said nozzle for actuation of said locking means in a direction generally parallel to an axis of an outlet orifice of said nozzle to disengage said locking means from said engagement means.

13. A child-resistant adjustable nozzle for a hand-operated liquid ejection apparatus, said apparatus including a discharge end which has an upper side and a lower side, insertable means having an upper side and a lower side in said discharge end for coupling said nozzle to said apparatus, said nozzle being movable into different positions relative to said insertable means including a liquid flow OFF position for said apparatus, passage means in said nozzle and on said insertable means in said discharge end adapted to form passageways for liquid conducted to said discharge end for ejection from said nozzle, which passageways are formed when said passage means are brought into register by adjustment of said nozzle relative to said insertable means and thereby determine the ejection or discharge mode of said apparatus, deflection means on the lower side of one of said nozzle and said insertable means and cooperating engagement means on the lower side of the other of said nozzle and insertable means adapted to engage said deflection means and lock said nozzle in child-resistant relationship with said apparatus when said nozzle and insertable means are moved into said liquid flow OFF position and said deflection means being integral with said insertable means.

* * * * *